US006681936B2

(12) United States Patent
Godshaw et al.

(10) Patent No.: US 6,681,936 B2
(45) Date of Patent: Jan. 27, 2004

(54) COSMETIC AND UTILITY KIT

(75) Inventors: Donald E. Godshaw, Evanston, IL (US); Andrzej M. Redzisz, Skokie, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 117 days.

(21) Appl. No.: 09/930,066

(22) Filed: Aug. 15, 2001

(65) Prior Publication Data

US 2002/0157912 A1 Oct. 31, 2002

Related U.S. Application Data

(60) Provisional application No. 60/225,247, filed on Aug. 15, 2000.

(51) Int. Cl.[7] ..... B65D 71/00; A45D 40/00; A45D 27/22; A45C 3/00

(52) U.S. Cl. ..... 206/581; 206/810; 132/312; 132/315; 190/113

(58) Field of Search ..... 206/581, 316.2, 206/320, 279, 287.1, 289, 766, 806, 810; 132/312, 314, 315, 286, 289, 290; 190/107, 113, 111, 901, 902; 150/112, 114, 118; 229/87.61, 87.04; D3/201, 265, 232, 233, 273, 274, 275, 293, 299, 301

(56) References Cited

U.S. PATENT DOCUMENTS

| | | | | | |
|---|---|---|---|---|---|
| 1,150,057 | A | * | 8/1915 | O'Neill | 190/107 |
| 1,214,282 | A | * | 1/1917 | Day | 206/581 |
| 1,722,507 | A | * | 7/1929 | Stanley | 206/581 |
| 2,764,201 | A | * | 9/1956 | Whippo | 206/581 |
| 3,777,862 | A | * | 12/1973 | Zipper | 190/107 |
| 3,904,003 | A | * | 9/1975 | Margerum | 190/11 |
| 5,086,888 | A | * | 2/1992 | Chu | 190/107 |
| 5,967,270 | A | * | 10/1999 | Shyr | 206/320 |
| 6,161,738 | A | * | 12/2000 | Norris | 150/119 |

* cited by examiner

*Primary Examiner*—Mickey Yu
*Assistant Examiner*—Gregory Pickett
(74) *Attorney, Agent, or Firm*—Banner & Witcoff, Ltd.

(57) ABSTRACT

A cosmetic and utility kit includes a container formed with a back side, bottom side, front side and opposite lateral side and further includes an extension flap extending from the back side that folds over the bottom side, front side and top side to enclose contents within the container.

13 Claims, 3 Drawing Sheets

COSMETIC AND UTILITY KIT

CROSS REFERENCE TO RELATED APPLICATION

This is a utility application based upon Ser. No. 60/225,247 filed Aug. 15, 2000 for which priority is claimed.

BACKGROUND OF THE INVENTION

In a principal aspect, the present invention relates to a luggage item typically referred to as a cosmetic or utility kit.

Travelers often desire to have available a smaller item of luggage, often termed a kit, to carry personal items, toiletries and the like. Such a luggage item is typically larger than a woman's handbag, but small enough to be conveniently carried and stored under the seat of an airliner or in the overhead compartment of an airliner. It is desirable, however, that such a kit or bag include various compartments, pouches, and pockets for storing items separately in a safe and secure manner. Further, it is desirable to provide a mirror in such kits that can be conveniently accessed without interference with the contents of the kit, yet will be incorporated in a manner which enables the mirror to be protected from breaking.

Another desire in such a kit, or luggage item, is to provide means whereby the item can be conveniently hung from a hanger or the like without spilling the contents while enabling ease of access to the contents and use of the kit.

SUMMARY OF THE INVENTION

Briefly, the present invention comprises a cosmetic and utility kit, or item of luggage, which includes a generally rectangular container having an open top and which further includes an extension panel that wraps around the bottom and front side of the kit and fits over the open top of the kit where the extension panel is retained by means of a zipper or other fastening mechanism to enclose the contents of the kit. A top flap then folds over and covers the flexible extension panel. Hanging straps are attached to the top flap or to the backside of the kit, or to both the top flap and backside of the kit, to enable the kit to be hung in a convenient manner with the extension flap open to expose the contents of the kit. A mirror and tray are incorporated in the extension flap which folds over the top side of the kit. Separate end pouches are provided at the opposite ends or sides of the kit.

Thus, it is an object of the invention to provide a cosmetic and utility kit which includes multiple pockets for separately storing various items in a protected manner.

A further object of the invention is to provide a cosmetic and utility kit which includes a container formed by a bottom side, back side, front side and opposite, lateral side panels defining an open top and further including an extension panel which folds over the bottom, front and top sides to provide an enclosure for storage of items.

Another object of the invention is to provide a utility and cosmetic kit which incorporates a tray and mirror to enable use of the kit when partially opened.

Another object of the invention is to provide a utility and cosmetic kit which is easily transported, lightweight, made from flexible fabric or material and which further includes zipper accessible pouches.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
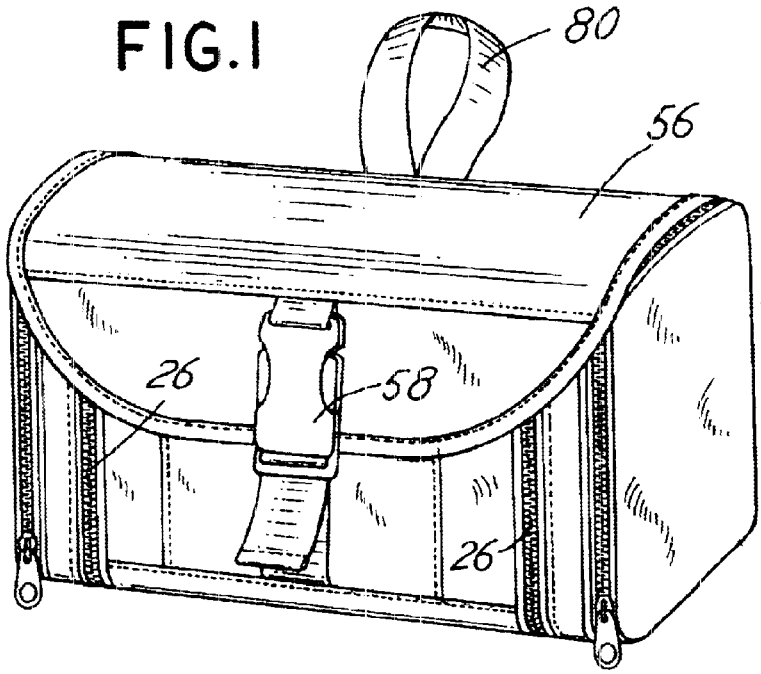
FIG. 1 is an isometric view of the kit viewed from the front side of the kit.

The cosmetic and utility kit of the present invention comprises a generally rectangular parallelepiped package, or container, which includes a back side 10, a front side 12 spaced from the back side 10, a first end panel 14, and a second end panel 16 parallel to and spaced from the first end panel 14. The first and second end panels 14 and 16 are connected to the back side 10 and to a bottom side 18. The bottom side 18 is connected to and forms an extension of the back side 10 connecting with the front side 12. The various sides 10, 12, 14, 16 and 18 form an enclosure with an open top side. The back side 10 is fabricated in combination with an overlay bottom extension 11, front panel extension 13 and top pocket extension 15 that define an elongate flexible extension panel 19 connected to lower edge 22 of the back side 10. In this fashion, the extension 19 comprising the panels 11 and 13 and a pocket 15 form a flap 19 which is foldable over the bottom side 18 and the front side 12 so that the pocket 15 fits over or into the open top of the defined by back side 10, front side 12, bottom side 18 and end sides or panels 14, 16. This elongate flap 19 comprising panels 11, 13 and pocket 15 may be attached to the formed container by a single zipper 26. Thus, the extension flap 19 may be held in position and attached to the container formed by the back side 10, bottom side 18, front side 12, and end panels 14 and 16.

Figure 3:
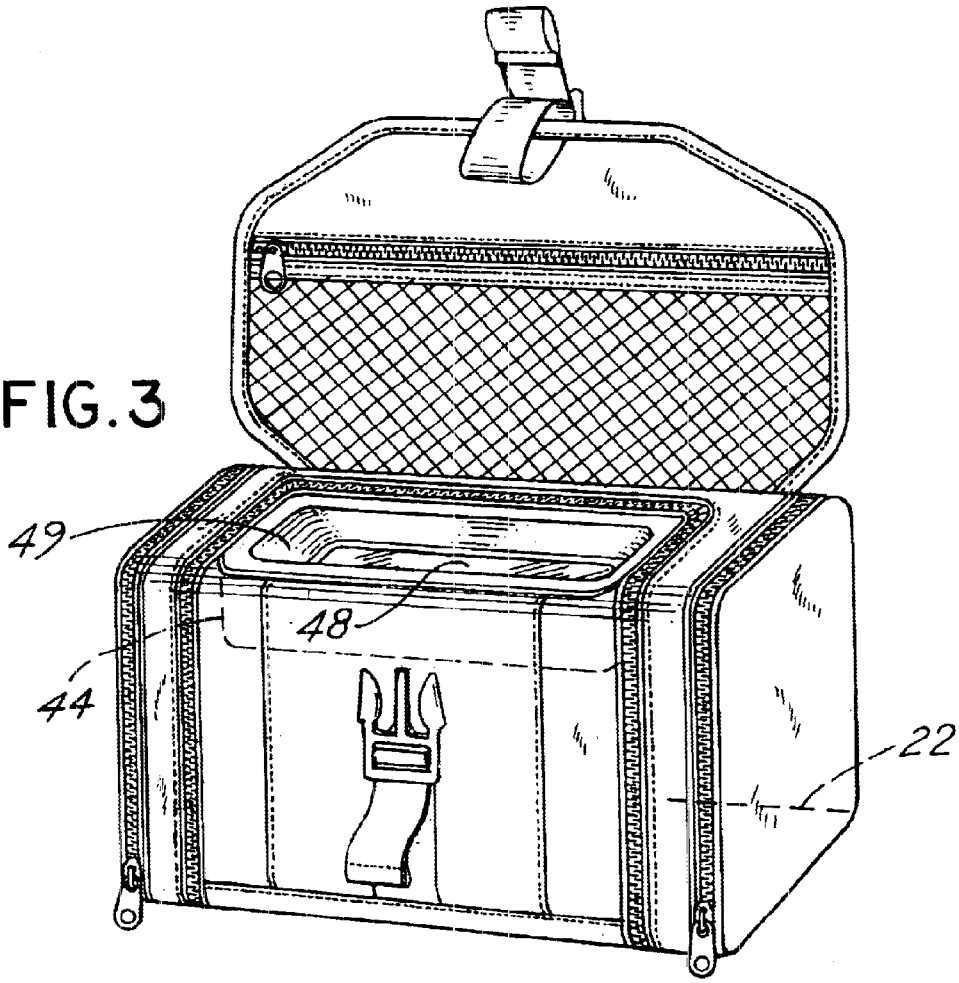
FIG. 3 is an isometric view of the kit of FIG. 2 in a partially opened position.

Various flexible mesh panels, such as mesh panel 30, may be provided to define pockets accessible through a zipper, for example, zipper 32 in the front panel 12. Similarly, mesh panel 40 on the inside of front covering panel extension 13 is accessed through a zipper opening 42 defining a pocket in the flap extension. The extension end or pocket 15 includes a zippered pouch 44 on the inside of the extension panel accessible through a zippered opening 46. The zippered pouch 44 may, when folded back into the interior of the enclosure, include a mirror 48 on the outside face thereof, or may be contoured to form a tray 49, such as depicted in FIG. 3.

A top cover flap 56 hinged to back side 10 and may be folded over the portion of extension 19 defined by the panel 13 and pocket 15. Flap 56 is attached to panel 13 by means of a strap or buckle 58 as shown in FIG. 1. The inside of the flap 56 includes a mesh pocket 60 with a zipper opening 62 for storage of additional items.

Pockets or pouches are also formed in association with each of the end panels 14 and 16. Thus, a pouch 66 is formed in combination with end panel 14 and access thereto is provided by a zipper 68. A pouch 70 accessible by a zipper 72 is associated with the end panel 16.

The interior of the enclosure defined by the sides or panels 10, 12 and 18 may include elastic restraining straps 74, for example, which will hold items, such as cosmetic items, within the enclosure. A mesh pocket formed by a mesh panel 76 may be provided within the pocket, such as pocket 66.

The kit further includes a hanging strap 80 which is attached to the back panel 10 at the juncture with the flap 56. Alternatively, the buckle 58 may comprise a hanging strap 81. Thus, both strap 80 and buckle 58 may be used or function to support or attach the kit to a hanger for easy access when traveling, by way of example.

Figure 2:
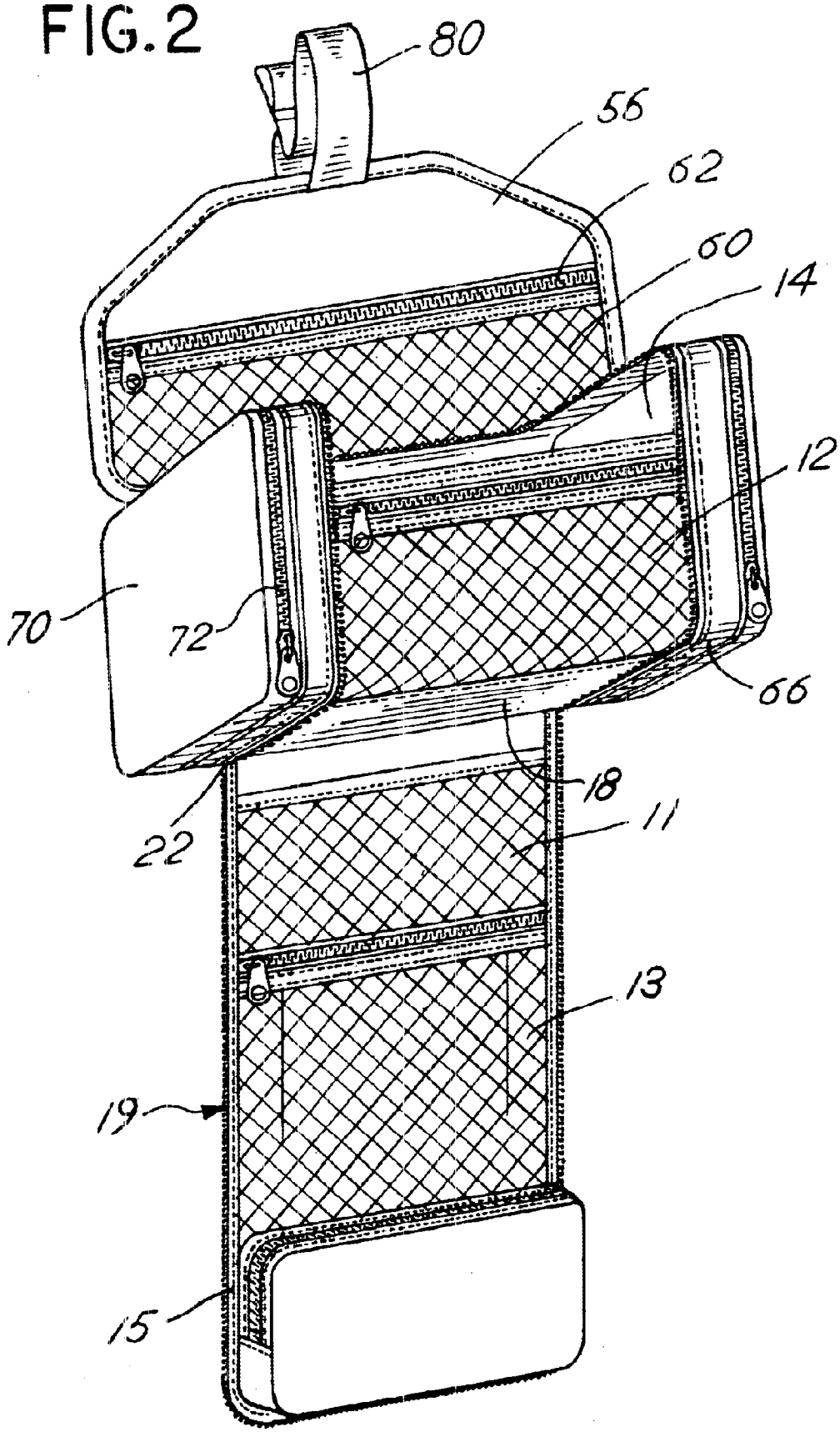
FIG. 2 is an isometric view of the kit of FIG. 1 in the open position.
Figure 4:
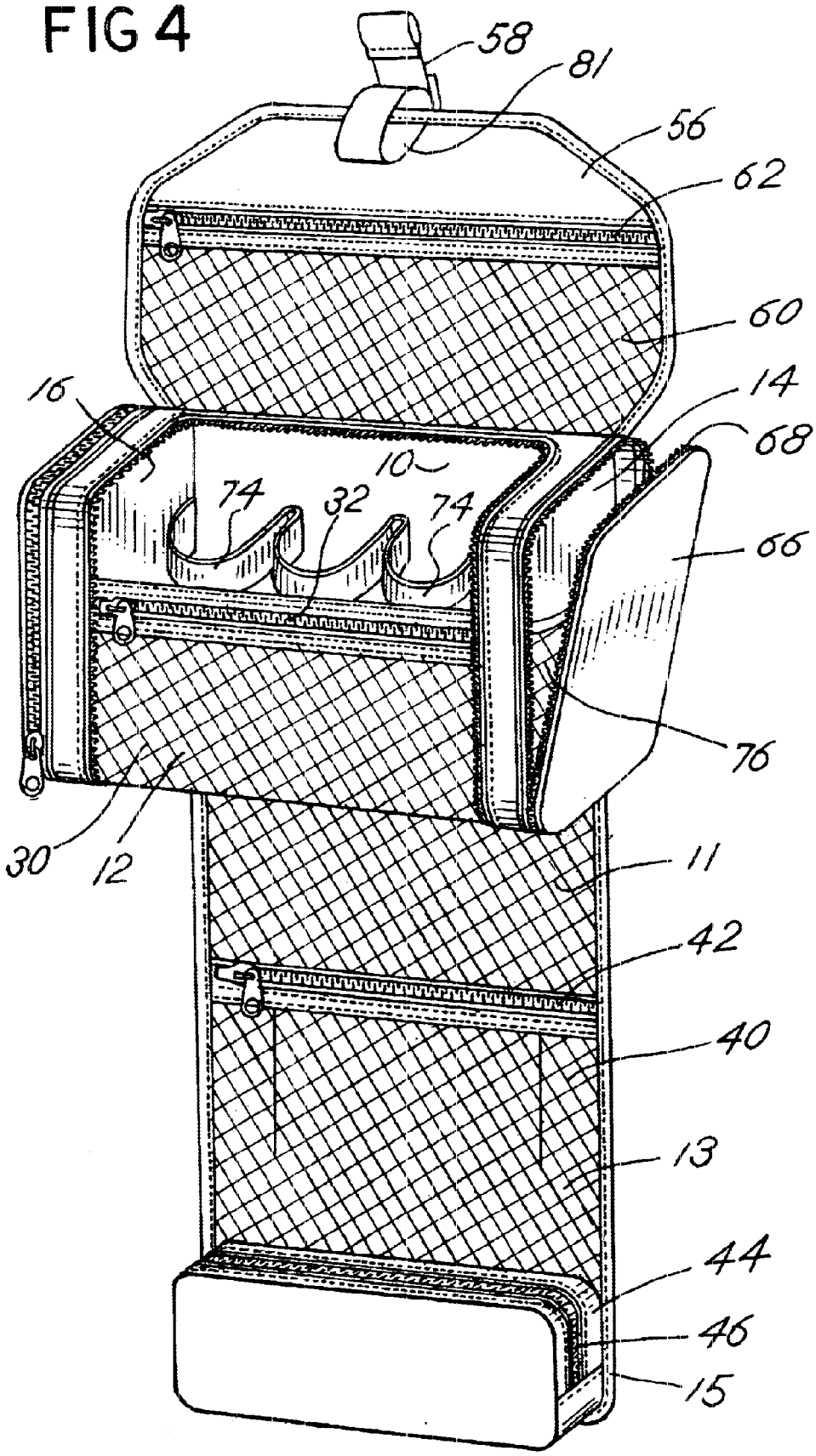
FIG. 4 is an isometric view of the kit of FIG. 2 wherein the interior of the kit is open and exposed for viewing.

One of the advantages of the kit is its utility in various circumstances. For example, as shown in the Figures, the zippers holding the extension flap or panel 19 may be fully opened and the kit may then be hung by the top flap 56 as shown in FIG. 2. In this manner, all of the contents of the kit may be easily accessed.

The construction of the kit as described enables maintaining back side 10 and extension 19 as well as flap 56 flat against a wall or door or thereby permitting ease of access to the contents of the kit.

However, if an individual is sitting, for example, in an airline seat and wishes to utilize the kit, for example, to apply make-up, the kit may be partially opened as depicted in FIG. 3. That is, the top flap 56 may be lifted and disengaged from its buckle. A mirror 48 can then be utilized and the tray 49 also can be utilized to retain items on the top of the kit. The items will thus be placed at the edges of the mirror 48 so that the mirror 48 may be utilized while the tray 49 retains the items conveniently so that they will not be dropped or lost. The tray 49 may be a premolded item which is shallow and serves as the inside panel of the pocket item 15. The support strap 80 in FIG. 1 may be utilized to hold the kit or container attached to the back of the chair or the seat while the kit is in the partially opened condition, as illustrated in FIG. 3 again, enabling use of the kit by virtue of partial opening of the top flap 56.

Various modifications may be made to the kit or luggage item. The pockets may be formed of mesh or fabric material. Zippers may be included or excluded. The end pouches may be included or excluded. The shape and form of the tray may be adjusted or amended. A mirror may be incorporated on the inside of the flap 56 and protected by padding, for example. Thus, the invention is to be limited only by the following claims and equivalents thereof.

What is claimed is:

1. A cosmetic and utility kit comprising, in combination:

a generally rectangular, parallelepiped container having a bottom side, a back side with an upper edge and a lower edge, said lower edge attached to the bottom side, a front side spaced from the back side, a first end panel, a second end panel spaced from the first end panel, said first and second end panels connected to the back side, bottom side and front side to form a storage enclosure with an open top;

an elongate, flexible bottom extension panel connected to the lower edge of the back side and defining a bottom extension of the back side, said bottom extension panel defining a flap foldable over the bottom side, the front side and the open top of the enclosure;

an elongate top flap extension panel connected to the upper edge of the back side and foldable over the open top and at least a part of the bottom extension panel when said bottom extension panel is folded over the open top, said top flap extension panel connectable to the bottom extension panel to retain the bottom extension panel folded over the front side and open top; and said bottom extension panel including an inside face and an outside face, said outside face including a tray.

2. The kit of claim 1 wherein the bottom extension panel includes an inside face and an outside face, and said outside face includes a mirror affixed thereto.

3. A cosmetic and utility kit comprising, in combination:

a generally rectangular, parallelepiped container having a bottom side, a back side with an upper edge and a lower edge, said lower edge attached to the bottom side, a front side spaced from the back side, a first end panel, a second end panel spaced from the first end panel, said first and second end panels connected to the back side, bottom side and front side to form a storage enclosure with an open top;

an elongate, flexible bottom extension panel connected to the lower edge of the back side and defining a bottom extension of the back side, said bottom extension panel defining a flap foldable over the bottom side, the front side and the open top of the enclosure;

an elongate top flap extension panel connected to the upper edge of the back side and foldable over the open top and at least a part of the bottom extension panel when said bottom extension panel is folded over the open top, said top flap extension panel connectable to the bottom extension panel to retain the bottom extension panel folded over the front side and open top; and said bottom extension panel including an inside face and an outside face, said outside face including a mirror affixed thereto.

4. The kit of claim 1 or 3 wherein the bottom extension panel includes an inside face and an outside face, and further including a pocket on the inside face positioned to fit in the open top of the enclosure when the bottom extension panel is folded over the open top.

5. The kit of claim 1 or 3 wherein the bottom extension panel includes a peripheral fastener for attaching the bottom extension panel over the bottom side, front side and open top.

6. The kit of claim 1 or 3 wherein the top extension panel includes an attachment member for supporting the top extension panel from a support member.

7. The kit of claim 1 or 3 including a storage pocket fitted over one of the first and second end panels.

8. The kit of claim 1 or 3 including a storage pocket fitted over each of the first and second end panels.

9. The kit of claim 1 or 3 wherein the bottom extension panel includes an inside face and an outside face, and further including a plurality of storage pockets on at least one face.

10. The kit of claim 1 or 3 wherein the top extension panel includes an inside face and an outside face, and further including a storage pocket on the inside face.

11. The kit of claim 1 or 3 wherein the front side includes a storage pocket.

12. The kit of claim 1 or 3 including a hanger member attached to the upper edge of the back side.

13. The kit of claim 3 wherein the bottom extension panel includes an inside face and an outside face and said outside face includes a tray.

* * * * *